US005846146A

United States Patent [19]

Grusd

[11] Patent Number: 5,846,146

[45] Date of Patent: Dec. 8, 1998

[54] DEVICE FOR REPAIRING OR REPLACING A BROKEN STRING ON A RACKET

[76] Inventor: Selwyn Grusd, 26 Fort Street, Birnam, South Africa

[21] Appl. No.: 988,057

[22] Filed: Dec. 10, 1997

[30] Foreign Application Priority Data

Dec. 11, 1996 [ZA] South Africa ..... 96/10415

[51] Int. Cl.[6] ..... A63B 51/14

[52] U.S. Cl. ..... 473/557

[58] Field of Search ..... 473/555, 556, 473/557, 534, 175, 179, 178; 242/157 R, 147 R

[56] References Cited

U.S. PATENT DOCUMENTS 3,837,649 9/1974 Burchett ..... 473/557
4,455,021 6/1984 Berque ..... 473/557 X
5,120,056 6/1992 Gharemani ..... 473/557
5,186,459 2/1993 Korte-jungermann ..... 473/556 X

*Primary Examiner*—Raleigh W. Chiu
*Attorney, Agent, or Firm*—Marshall & Melhorn

[57] ABSTRACT

The present invention relates to a device for repairing or replacing a broken string on a racket. The device comprises a first string gripping member for gripping a portion of a broken or replacement string outside the frame of a racket; a second string gripping member for gripping a portion of the broken or replacement string inside the frame of the racket; a connector for connecting the first and second string gripping members; and a reaction member, in the form of a plate, located on the connector between the first and second string gripping members. The reaction member is arranged to bear against the frame of the racket and, together with the first string gripping member, to apply a tension to the string, and together with the second string gripping member, to hold the string under tension so as to allow the string to be connected to the frame of the racket in a tensioned state.

13 Claims, 3 Drawing Sheets

DEVICE FOR REPAIRING OR REPLACING A BROKEN STRING ON A RACKET

BACKGROUND OF THE INVENTION

THIS invention relates to a device for repairing or replacing a broken string on a racket.

Various sports involve the use of a racket. Generally, when one of the strings of such a racket snaps during play, the players have to stop play unless they have access to another racket. This is usually frustrating for the players especially if the string snaps at a critical point in a game.

Repairing or replacing the relevant string normally involves taking the racket to a shop or the like having suitable equipment for repairing the racket. This may be impractical at the time that the string snaps.

For the purposes of this specification, the term string refers to the strings of a racket which may be formed from catgut, nylon etc.

SUMMARY OF THE INVENTION

According to the invention there is provided a device for repairing or replacing a broken string on a racket, the device comprising:

- a first string gripping member for gripping a portion of a broken or replacement string outside the frame of a racket;
- a second string gripping member for gripping a portion of the broken or replacement string inside the frame of the racket;
- a connector for connecting the first and second string gripping members; and
- a reaction member located on the connector, between the first and second string gripping members, the reaction member being arranged to bear against the frame of the racket and, together with the first string gripping member, to apply a tension to the string, and together with the second string gripping member, to hold the string under tension so as to allow the string to be connected to the frame of the racket in a tensioned state.

In the preferred form of the invention the connector is in the form of a threaded shaft and the reaction member has a threaded formation thereon so that rotation of the threaded shaft relative to the threaded formation causes linear movement of the reaction member along the threaded shaft.

The reaction member may be in the form of a plate.

Preferably, the reaction member is shaped to have two elongate, substantially parallel legs for receiving the broken or replacement string therebetween when the string extends between the first and second string gripping members.

Conveniently, the reaction member includes a blade for cutting any excess string which may extend from the frame after the broken or replacement string has been repaired or replaced.

Each of the first and second string gripping members may include an aperture or a recess for receiving a portion of the broken or replacement string and a clamping means for clamping the portion of the string against a side of the aperture or recess.

Preferably, the clamping means comprises a threaded shaft which is arranged to turn on a thread so as to be movable across the aperture or recess.

BRIEF DESCRIPTION OF THE DRAWINGS

The invention will now be described in more detail, by way of example only, with reference to the accompanying drawings in which.

DESCRIPTION OF EMBODIMENTS

Figure 1:
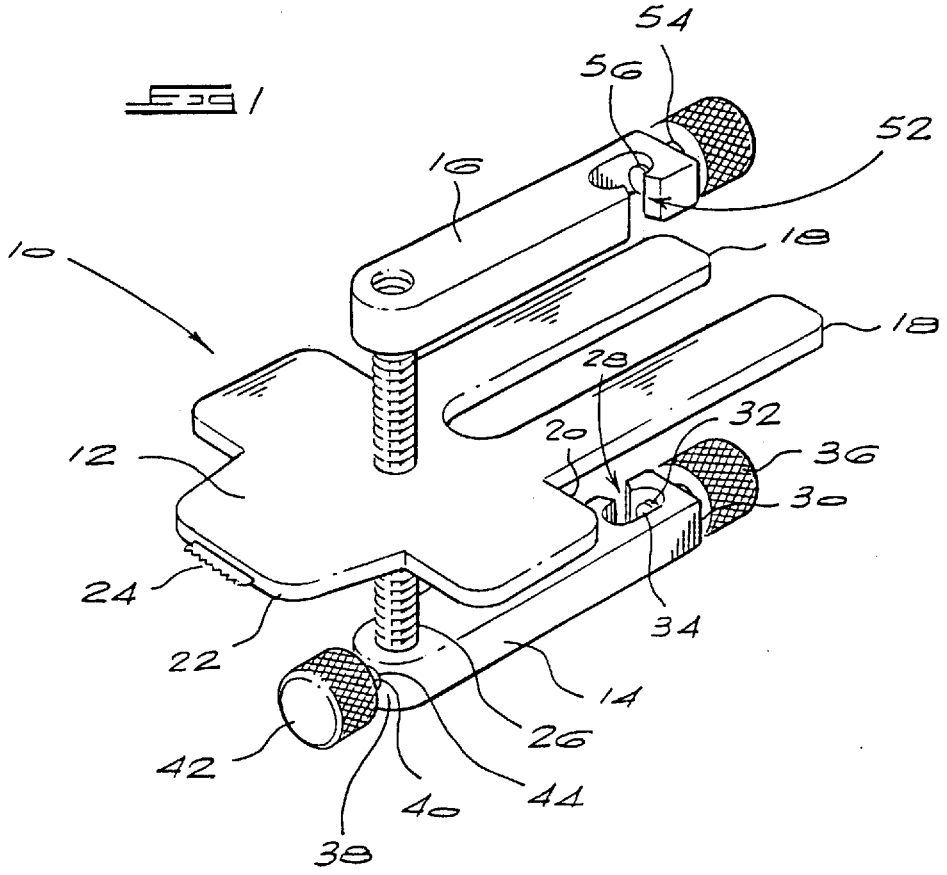
FIG. 1 shows a perspective view of a device according to the present invention.

Referring to FIG. 1 of the drawings, there is shown a device 10 for repairing or replacing a broken string of a racket. The device 10 includes a reaction plate 12, a first string gripping member 14 and a second string gripping member 16.

The plate 12 includes two elongate, substantially parallel legs 18 which extend from one edge 20 of the plate. On another edge 22, the plate 12 carries a blade 24.

The first gripping member 14 is connected to the plate 12 by way of a threaded shaft 26. The griping member 14 includes a groove 28 towards one of its ends 30. An aperture 32 passes through the member 14 from the groove 28 to the end 30 of the member. The aperture 32 has an internal thread along its length so as to receive a threaded shaft 34. The shaft 34 is arranged to pass through the aperture 32 so as to be movable across the groove 28, and has a knurled head 36 for turning the shaft into or out of the aperture 32.

Figure 2:
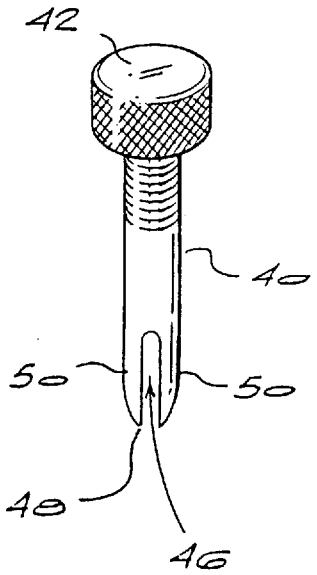
FIG. 2 shows a perspective view of a knot locator which forms part of the device of FIG. 1.

On an opposite end 38 of the member 14, there is a second shaft 40 which has a thread running along at least a portion of its length. The shaft 40 has a knurled head 42 and is arranged to be received within a threaded recess 44. With reference now to FIG. 2 of the drawings, the threaded shaft 40 is shown outside of the recess 44 and includes a slot 46 at an end 48 of the shaft for receiving a length of string between two spaced apart fingers 50 formed by the slot.

Referring back to FIG. 1, the gripping member 16, similarly to the gripping member 14, also has a groove 52, and a threaded shaft 54 arranged to pass through a threaded aperture 56 so as to be movable across the groove. Once again the gripping member 16 is connected to the plate 12 by means of the threaded shaft 26 which passes through the plate 12, as shown.

The way in which a broken string is repaired with the aid of the device 10 will now be described with reference to FIGS. 3 and 4 of the drawings.

Figure 3:
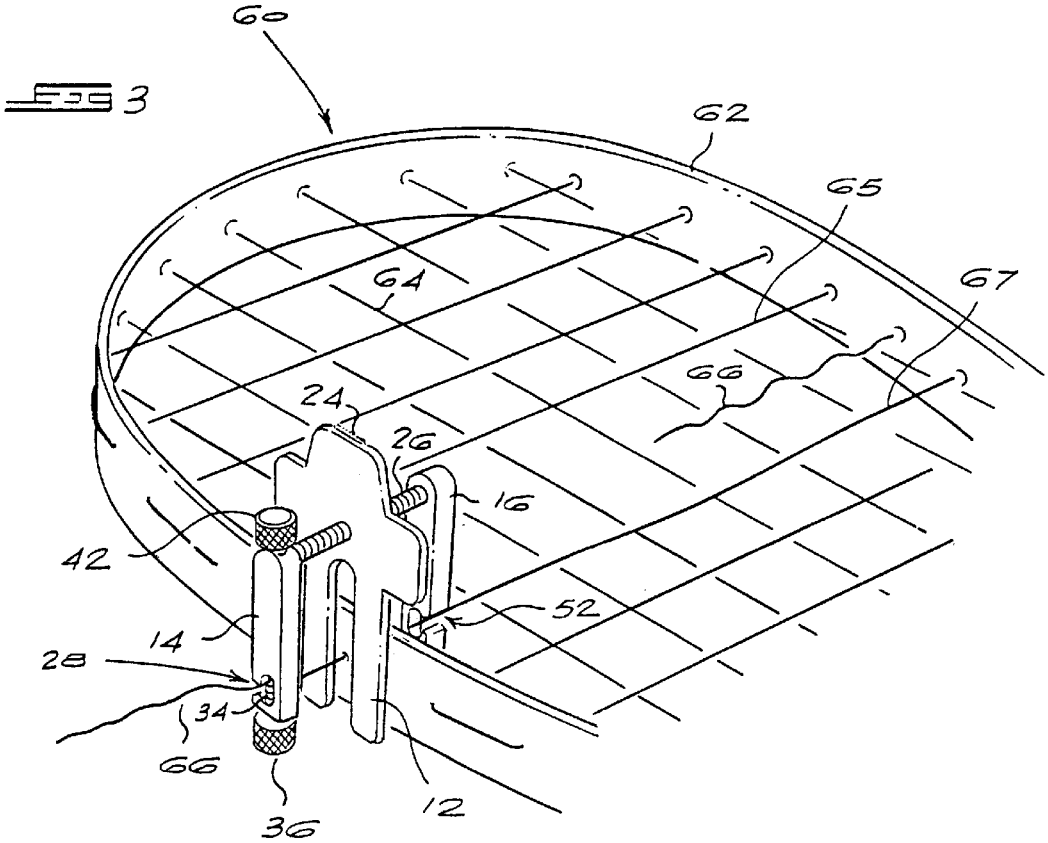
FIG. 3 shows a partial perspective view of the device of FIG. 1 mounted on the frame of a racket in an early stage of the string repairing procedure.

With reference first to FIG. 3, there is shown a racket 60 having a frame 62 and a plurality of lengths of string 64 spanning across the inner surface of the frame. In the event that one of the lengths of string 66 snaps while a user of the racket 60 is using the racket, the length of string can be repaired as follows.

Firstly, a portion of the length of string 66 is withdrawn from an aperture 68 so as to lie outside of the frame 62. Thereafter the device 10 is mounted onto the frame by placing the plate 12 against the outer side of the frame 62 in the vicinity of the broken string 66, with the second gripping member 16 located within the frame and the first gripping member 14 located outside of the frame, as shown.

The end portion of the broken string 66 located outside of the frame 62 is then placed within the groove 28 and the knurled head 36 is tightened so as to move the threaded shaft 34 across the groove and to clamp the string between the end of the threaded shaft and the side of the groove. A portion of the length of string 67 is then placed within the groove 52 of the gripping member 16, but the threaded shaft 54 is not tightened so as to grip the length of string 67. In this way the length of string 67 is free to slide within the groove 52.

Figure 4:
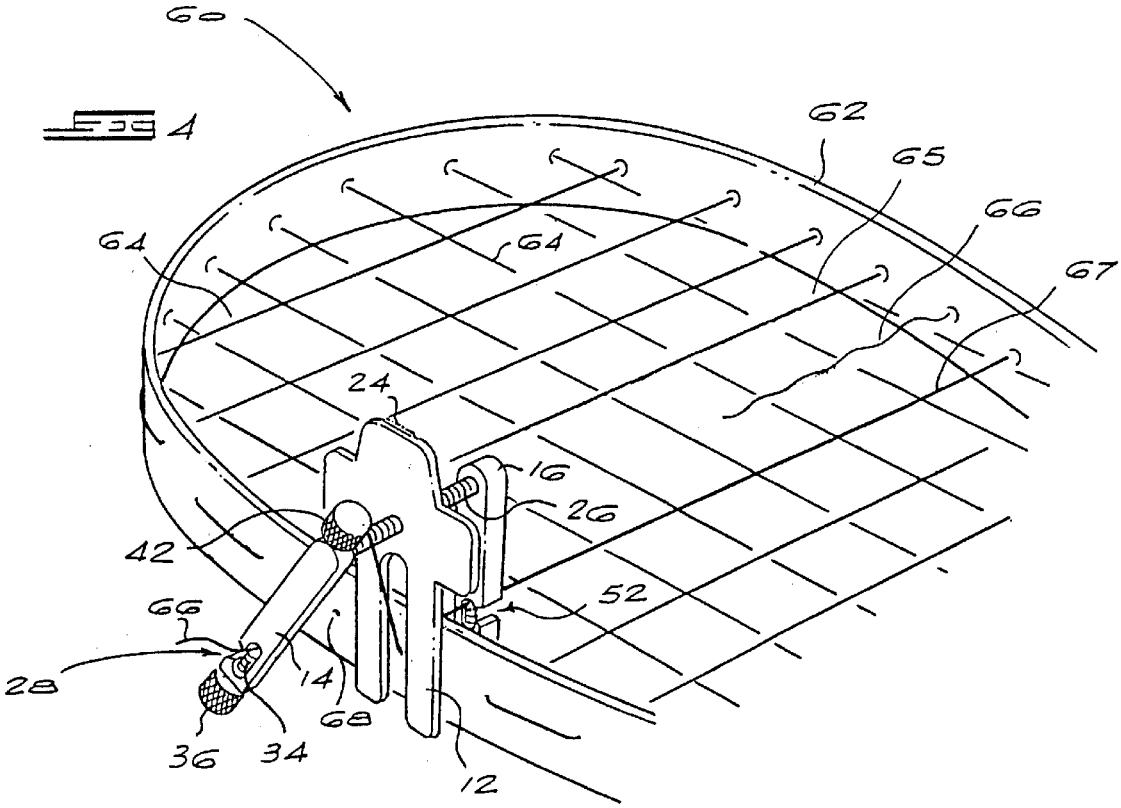
FIG. 4 shows a partial perspective view similar to that of FIG. 3 but with the device in a more advanced stage of the string repairing procedure.

At this point the first gripping member 14 is rotated about the threaded shaft 26 into the position illustrated in FIG. 4, so as to move the gripping member 14 away from the plate 12. As this occurs, the gripping member 14 pulls the length of string 66 away from the frame 62 and the length of string 67 is thereby tensioned. As the length of string 67 is tensioned, it slides within the groove 52. Once the length of string 67 reaches a desired tension, the threaded shaft 54 on the second gripping member 16 is then tightened so as to grip the length of string 67 and to hold this length of string under tension.

Thereafter, the threaded shaft 34 on the gripping member 14 is turned so as to move back across the groove 28 and release the length of string 66. The tension in the length of string 67 is maintained by the interaction of the gripping member 16, which holds the length of string 67, and the reaction plate 12 which bears against the frame 62.

A knot is then tied in the length of string 66 located on the outer side of the frame 62. The knot is tied as close to the frame 62 as possible and the threaded shaft 40 with slot 46 is used to force the knot directly against the frame 62 by sliding the shaft 40 along the length of string, with the length of string received within the slot 46, towards the frame 62.

Finally, once the knot is located against the frame 62 so as to maintain the tension in the length of string 67, the shaft 54 on the gripping member 16 is unscrewed so as to release the length of string 67 and the device 10 is removed from the racket 60. The knot is tied as close to the frame 62 as possible so as to prevent substantial reduction in the tension of the length of string 67 once the device 10 is removed from the racket.

The blade 24 can then be used to cut the remaining portion of the length of string 66 which extends from the knot on the outside of the frame 62.

A similar procedure to that described above can then be used to secure the other portion of the length of string 66 to the frame 62 so as to connect the length of string 65 to the frame under a desired tension. To replace the original length of string 66, a new length of string may then be connected to the racket in a manner similar to that described above.

The entire device may be formed from a plastics material, but in the embodiment described, the plate 12, and the gripping members 14 and 16 are moulded from a plastics material, while the threaded shafts and the corresponding threads with which they interact are all formed from steel.

An advantage of the device of the invention is that when one of the strings of a racket snaps during play, the player can repair the racket immediately so as to be able to continue play shortly thereafter. Accordingly, it is not necessary, at the time that the string snaps, to take the racket to a shop or the like having suitable equipment for repairing the racket. Furthermore, the device of the invention is adjustable so as to be able to fit various sizes of frames of different types of rackets. The portable device is also relatively small and therefore easy to carry along with a racket.

Figure 5:
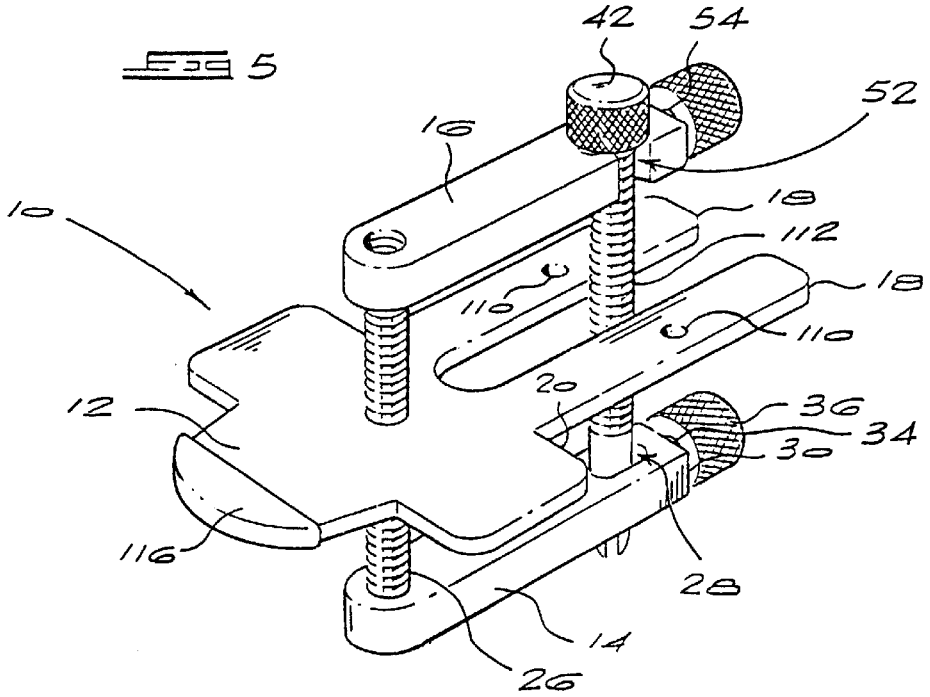
FIG. 5 shows a perspective view of a second embodiment of the device of the present invention.
Figure 6:
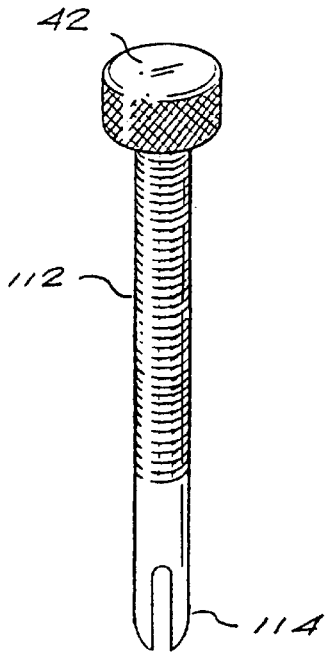
FIG. 6 shows a perspective view of a knot locator which forms part of the device of FIG. 5.

FIGS. 5 and 6 of the drawings illustrate a second embodiment of the device of the invention, FIG. 5 showing a perspective view of the device and FIG. 6 showing a perspective view of a knot locator which forms part of the device of FIG. 5.

The basic structure of this embodiment is the same as that of the first embodiment, and accordingly like reference numerals have been used to indicate like components.

With reference to FIG. 5 of the drawings, it can be seen that the reaction plate 12 includes a pair of apertures 110 in the legs 18. These apertures 110 facilitate the tightening of the knot in the replacement or broken string once the string has been tensioned.

The replacement of a replacement string or the repairing of a broken string using the device illustrated in FIG. 5 of the drawings is carried out in a similar manner to that of the first embodiment up to the point at which a knot is tied in the free end of the string being tensioned. In the case of the second embodiment, once the string has been tensioned and a knot has been tied in the end of the string, the free end of the string is threaded through either of the apertures 110 from the side of the reaction plate 12 closest to the frame of the racket. The free end of the string is then captured in the groove 28 by suitable rotation of the threaded shaft 34 and the member 14 is thereafter rotated so as to pull the knot up against the underside of the reaction plate 12. When this occurs the knot is tightened and simultaneously displaced a small distance along the length of the string.

Thereafter the member 14 and the threaded shaft 34 are counter-rotated so as to release the free end of the string, and the device 10 is removed from the racket in a similar manner to that of the first embodiment, so that the knot in the string bears up against the outside of the frame of the racket and retains the tension in the string. At this point the string is wound around itself below the knot, i.e. between the knot and the frame of the racket, forcing the knot away from the frame and thereby increasing the tension in the string even further, and subsequently the string is tied so as to form a second knot, below the first knot. In this way a secure knot arrangement is formed for retaining the tension in the string.

The main purpose of the shaft 112 in this case is to assist in the tying of the second knot by displacing, in a lever fashion, the first knot away from the frame once the forked end 114 of the shaft 112 has been wedged between the first knot and the frame. As can be seen from FIG. 6, the shaft 112 has a greater length than the shaft 40 of the first embodiment, which allows the shaft 112 to be stored in the grooves 28 and 52, with the threaded shafts 34 and 54 clamping the shaft 112 in these grooves (as shown in FIG. 5). Apart from the difference in length, the shaft 112 is substantially the same as the shaft 40, and can hence also be used to displace the knot in the string in the manner described above in the first embodiment of the invention.

The device of the second embodiment of the invention further includes a protective plastic cap 116 for covering the blade 24. This protective cap prevents the blade from causing damage to objects which it may contact when the device is not being used.

I claim:

1. A device for repairing or replacing a broken string on a racket, the device comprising:

a first string gripping member for gripping a portion of a broken or replacement string outside the frame of a racket;

a second string gripping member for gripping a portion of the broken or replacement string inside the frame of the racket;

a connector for connecting the first and second string gripping members; and a reaction member located on the connector, between the first and second string gripping members, the reaction member being arranged to bear against the frame of the racket and, together with the first string gripping member, to apply a tension to the string, and together with the second string gripping member, to hold the string under tension so as to allow the string to be connected to the frame of the racket in a tensioned state.

2. A device according to claim 1, wherein the connector is in the form of a threaded shaft and the reaction member has a threaded formation thereon so that rotation of the threaded shaft relative to the threaded formation causes linear movement of the reaction member along the threaded shaft.

3. A device according to claim 2, wherein at least one of the first and second string gripping members is movable along the threaded shaft.

4. A device according to claim 1, wherein the reaction member is in the form of a plate.

5. A device according to claim 1, wherein the reaction member includes two elongate, substantially parallel legs arranged to receive the broken or replacement string therebetween when the string extends between the first and second string gripping members.

6. A device according to claim 5, wherein at least one of the legs includes an aperture through which the string can be threaded for facilitating the connection of the string to the frame of the racket.

7. A device according to claim 1, wherein the reaction member includes a blade for cutting the string.

8. A device according to claim 7, wherein the device includes a protective cover for the blade.

9. A device according to claim 1, wherein each of the first and second string gripping members includes an aperture or a recess for receiving a portion of the broken or replacement string and a clamping means for clamping the portion of the string against a side of the aperture or recess.

10. A device according to claim 9, wherein the clamping means comprises a threaded shaft which is arranged to turn on a thread so as to be movable across the aperture or recess thereby to clamp the string against a side of the aperture or recess.

11. A device according to claim 1, wherein the device includes means for shifting the position of a knot in the string so as to allow the knot to be positioned adjacent to the frame of the racket.

12. A device according to claim 11, wherein the means for shifting the position of a knot in the string is releasably attachable to the device, so as to be storable on the device.

13. A device according to claim 12, wherein the means for shifting the position of a knot in the string is releasably attachable to the first string gripping member, the second string gripping member, or both the first and the second string gripping members.

* * * * *